US006418882B1

(12) United States Patent
Trant et al.

(10) Patent No.: US 6,418,882 B1
(45) Date of Patent: Jul. 16, 2002

(54) POWER VENTED, FUEL FIRED WATER HEATER WITH SOFT IGNITION SYSTEM

(75) Inventors: Troy E. Trant; Michael L. Burney; William T. Harrigill; Gordon W. Stretch, all of Montgomery, AL (US)

(73) Assignee: The Water Heater Industry Joint Research and Development Consortium, Reston, VA (US)

( * ) Notice: Subject to any disclaimer, the term of this patent is extended or adjusted under 35 U.S.C. 154(b) by 0 days.

(21) Appl. No.: 09/833,894

(22) Filed: Apr. 12, 2001

(51) Int. Cl.[7] ..... F22B 5/04

(52) U.S. Cl. ..... 122/14.1; 122/14.21; 110/162; 126/361.1

(58) Field of Search ..... 122/13.01, 14.21, 122/14.1, 17.1; 110/162; 126/361.1, 362.1

(56) References Cited

U.S. PATENT DOCUMENTS 4,492,185 A * 1/1985 Kendall et al. ..... 122/17.1
4,925,093 A * 5/1990 Moore, Jr. et al. ..... 122/17.1
5,197,665 A * 3/1993 Jenson et al. ..... 431/31
5,697,330 A * 12/1997 Yetman et al. ..... 122/13.1
5,950,573 A * 9/1999 Shellenberger et al. .... 122/13.1

* cited by examiner

*Primary Examiner*—Gregory Wilson
(74) *Attorney, Agent, or Firm*—Konneker & Smith, P.C.

(57) ABSTRACT

A power vented, gas fired water heater has a main gas burner disposed within a combustion chamber partially bounded by an arrestor plate having a spaced series of flame quenching combustion air inlet openings therein. To provide for a "soft" ignition of extraneous flammable vapors entering the combustion chamber and to limit the build-up of unignited flammable vapors within the combustion chamber during non-demand periods of the water heater, a non-flame type ignition device is disposed within the combustion chamber and operated at least intermittently during such non-demand periods.

22 Claims, 3 Drawing Sheets

POWER VENTED, FUEL FIRED WATER HEATER WITH SOFT IGNITION SYSTEM

BACKGROUND OF THE INVENTION

The present invention generally relates to fuel-fired heating appliances and, in a preferred embodiment thereof, more particularly provides a specially designed power vented, gas fired water heater having incorporated in its combustion chamber a non-flame type burner ignition system which operates at least intermittently during non-demand periods of the water heater to controllably ignite flammable vapors entering the combustion chamber through a flame arresting perforated plate structure.

Gas-fired residential and commercial water heaters are generally formed to include a vertical cylindrical water storage tank with a main gas burner disposed in a combustion chamber beneath the tank. The main burner is supplied with a fuel gas through a gas supply line, and combustion air through an air inlet flow path providing communication between the exterior of the water heater and the interior of the combustion chamber. In applications in which a sufficient natural draft is not available to draw hot combustion products upwardly through the flue portion of the water heater, to thereby transfer combustion heat to the water stored in its tank, a draft inducer fan is operatively coupled to the flue. Water heaters of this type, in which a fan is used to provide the necessary draft during water heating periods, are commonly referred to as power-vented water heaters.

Fuel fired water heaters extremely safe and quite reliable in operation. However, under certain circumstances extraneous flammable vapors from outside the water heater may enter the combustion chamber and be ignited therein. various proposals have previously been made to controllably ignite such extraneous vapors within the combustion chamber. one such proposal has been to provide an outer wall portion of the combustion chamber with flame quenching openings disposed therein and operative to permit ambient combustion air and extraneous flammable vapors to flow therethrough into the combustion chamber and be ignited, but preclude the reverse passage of flames through the flame quenching openings.

This proposed solution lends itself particularly well to gas fired water heaters operating under natural draft conditions and provided with standing pilot flames since extraneous flammable vapors entering the combustion chamber during non-demand periods of the water heater tend to be simply burned in a controlled manner by the standing pilot flame as they enter the combustion chamber.

However, the use of a standing pilot flame in a power vented gas fired water heater is not generally feasible since during non-demand periods of the water heater (in which the draft inducer fan is not operated), there is typically not sufficient natural draft present to exhaust the combustion products of a standing pilot flame. Instead, a spark igniter is typically provided in a power vented gas fired water heater and is operated, to light the main gas burner, only when a demand for water heating is present. Thus, during non-demand periods of the water heater, it may under certain circumstances be possible for extraneous flammable vapors to enter the combustion chamber through its arrestor plate flame quenching openings and accumulate in an unignited condition in the combustion chamber until a water heating demand signal is received to operate the spark igniter and light the main gas burner. The resulting ignition of the flammable vapors within the combustion chamber may undesirably tend to be more forceful than would be the case of a standing pilot flame maintained in the combustion chamber of a natural draft water heater.

in view of this, it would be desirable to provide a technique for more controllably igniting extraneous flammable vapors that may enter the combustion chamber of a power vented, fuel fired water heater during non-heating demand periods thereof. It is to this goal that the present invention is directed.

SUMMARY OF THE INVENTION

In carrying out principles of the present invention, in accordance with a preferred embodiment thereof, a power vented, fuel fired heating apparatus is provided which is representatively a gas fired water heater and comprises a combustion chamber thermally communicatable with a fluid to be heated, the combustion chamber being partially bounded by a flame arrestor portion with spaced flame quenching combustion air inlet openings therein. A fuel burner is disposed within the combustion chamber and is operable during heating demand periods of the heating apparatus, a flue is operatively communicated with the combustion chamber, and a fan is associated with the flue and is operable to create a forced draft therein during the heating demand periods of the heating apparatus.

According to a key feature of the invention, the heating apparatus also comprises ignition apparatus including a non-flame type ignition device disposed within the combustion chamber and operative at least intermittently during non-heating demand periods of the heating apparatus. In this manner, extraneous flammable vapors which may migrate into the combustion chamber via the flame quenching combustion air inlet openings in its flame arrestor portion during a non-heating demand period of the heating apparatus are ignited with a relatively soft ignition force during such non-heating demand period.

In a first illustrative embodiment of the heating apparatus, the ignition apparatus comprises a first spark igniter operative to light the fuel burner at the beginning of each heating demand period, and a second spark igniter operable intermittently (representatively at intervals of from about 15 seconds to about 30 seconds) during non-heating demand periods to provide a softened ignition for extraneous flammable vapors that might enter the combustion chamber through the flame quenching combustion air inlet openings of its flame arrestor portion.

In a second illustrative embodiment of the heating apparatus, the ignition apparatus comprises a single spark igniter which is operable at the beginning of each heating demand period to light the fuel burner, and is also operable intermittently (representatively at intervals of from about 15 seconds to about 30 seconds) during non-heating demand periods to provide a softened ignition for extraneous flammable vapors that might enter the combustion chamber through the flame quenching combustion air inlet openings of its flame arrestor portion.

In a third illustrative embodiment of the heating apparatus, the ignition apparatus comprises a spark igniter which is operable at the beginning of each heating demand period to light the fuel burner, and an auxiliary non-flame type ignition device, such as a hot surface igniter or a glow coil, which is continuously operable during non-heating demand periods to provide a softened ignition for extraneous flammable vapors that might enter the combustion chamber through the flame quenching combustion air inlet openings of its flame arrestor portion.

DETAILED DESCRIPTION

Figure 1:
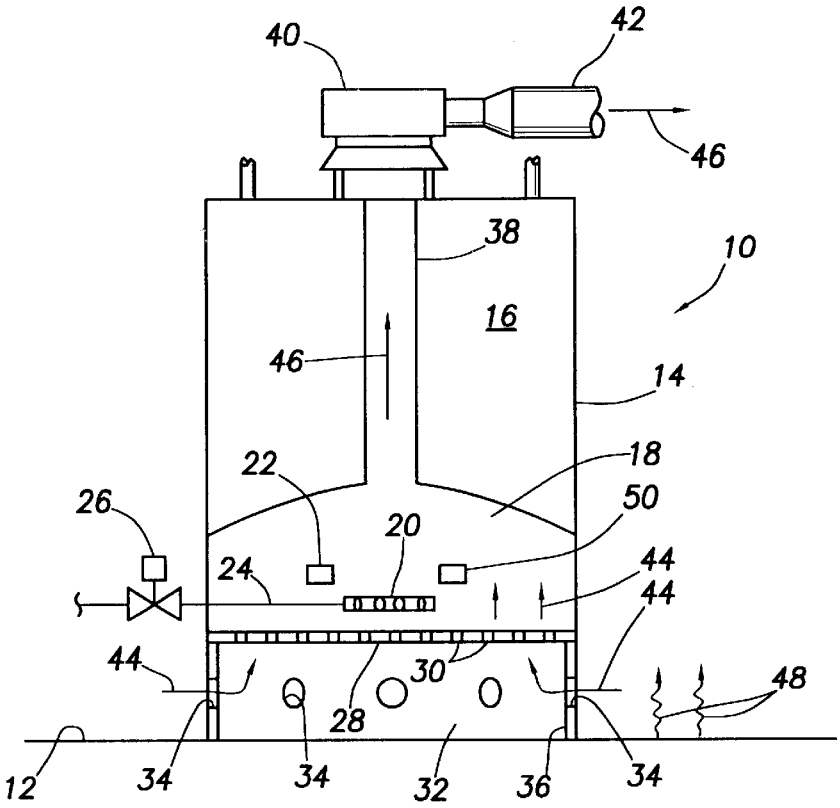
FIG. 1 schematically illustrates in simplified form a first embodiment of a power vented gas fired water heater embodying principles of the present invention.

Schematically depicted in FIG. 1 is a power vented, gas fired water heater 10 which embodies principles of the present invention. Water heater 10 rests on a floor 12 and has a tank portion 14 in which a quantity of heated water 16 is stored for on-demand delivery to hot water-utilizing plumbing fixtures such as sinks, showers, bathtubs, dishwashers and the like. A combustion chamber 18 is disposed beneath the tank 14 and has a main gas burner 20, and an associated burner-lighting ignition device 22, operatively disposed therein. A gas supply line 24, having a thermostatically controlled valve 26 therein, is connected to the burner 20. The burner-lighting device 22 is a conventional spark ignition device which operates when there is a demand for adding heat to the water 16.

The bottom wall of the combustion chamber 18 is defined by an arrestor plate 28 having a spaced series of flame quenching air inlet openings 30 therein. Beneath the arrestor plate 28 is an air inlet plenum 32 that opens outwardly through a circumferentially spaced series of air inlet openings 34 formed in an annular skirt portion 36 at the lower end of the water heater 10. A flue 38 extends upwardly from the combustion chamber 18, through the water 16 in the tank 14, and is communicated at its upper end with the inlet of a draft inducer fan 40 suitably mounted on the top end of the body of the water heater 10. Fan 40 has an outlet connected to a horizontally extending vent pipe 42.

During firing of the water heater 10, gas is supplied to the burner 20 via the gas supply line 24, under the control of the valve 26, mixed with ambient combustion air 44 drawn into the combustion chamber 18 by the fan 40 (via the flame quenching openings 30 in the arrestor plate 28) through the skirt openings 34 and the plenum 32, and combusted with the gas by the burner 20 upon lighting thereof by the spark ignition device 22. Resulting hot combustion products 46 flow upwardly through the flue 38 and are discharged into the vent pipe 42 by the draft inducer fan 40 which operates during firing cycles of the water heater 10 but is otherwise idle. Heat from the combustion products 46 is transferred to the water 16.

During firing of the water heater 10, the arrestor plate flame quenching openings 30 serve to permit flammable vapors 48 (created, for example, by a flammable liquid spill adjacent the water heater) to pass upwardly into the combustion chamber 18 and be burned therein, but prevent the downward discharge. of flames through the arrestor plate openings 30. Arrestor plate 28 may be of any suitable construction, with an example of an arrestor plate structure incorporated in a gas-fired water heater being shown in U.S. Pat. No. 6,035,812 to Harrigill et al. As described above, the overall combustion air inlet path into the combustion chamber 18 representatively extends through the skirt openings 34 and the bottom end plenum 32. This air inlet path to the arrestor plate, however, is merely representative and a variety of other air inlet path configurations and constructions could be employed if desired.

As in the case of conventionally constructed power vented gas fired water heaters, the spark igniter 22 is operated only when it is desired to fire the water heater 10, and is idle during all off-duty (i.e., "non-firing") periods of the water heater). A standing pilot flame, conventionally employed in natural draft water heaters, is typically not feasible as a main burner-lighting mechanism in a power vented gas fired water heater since there is usually not enough natural draft through the flue during non-firing periods of the water heater.

The use in a conventionally constructed power vented, gas fired water heater of a spark igniter to light the main burner presents the possibility that during off-duty (i.e., non-heating demand) periods of the water heater a quantity of flammable vapor 48 can migrate into the combustion chamber (due to a small natural draft created by the water-warmed flue 38 during non-demand periods of the water heater 10) and build up therein until ignited by the spark igniter 22 upon the initiation of the next firing cycle. When the spark igniter 22 is subsequently activated in response to a water heating demand, an undesirably "hard" ignition of the built-up flammable vapors can occur.

According to a key aspect of the present invention, the possibility of this potentially hard ignition of flammable vapors entering the combustion chamber 18 during non-demand periods of the water heater 10 is substantially eliminated by providing within the combustion chamber 18 a second non-flame type ignition device, representatively a second spark igniter 50, which is intermittently operated during non-demand or standby periods of the water heater 10. Spark igniters 22 and 50 are representatively incorporated in the schematically depicted control circuit of FIG. 2.

Figure 2:
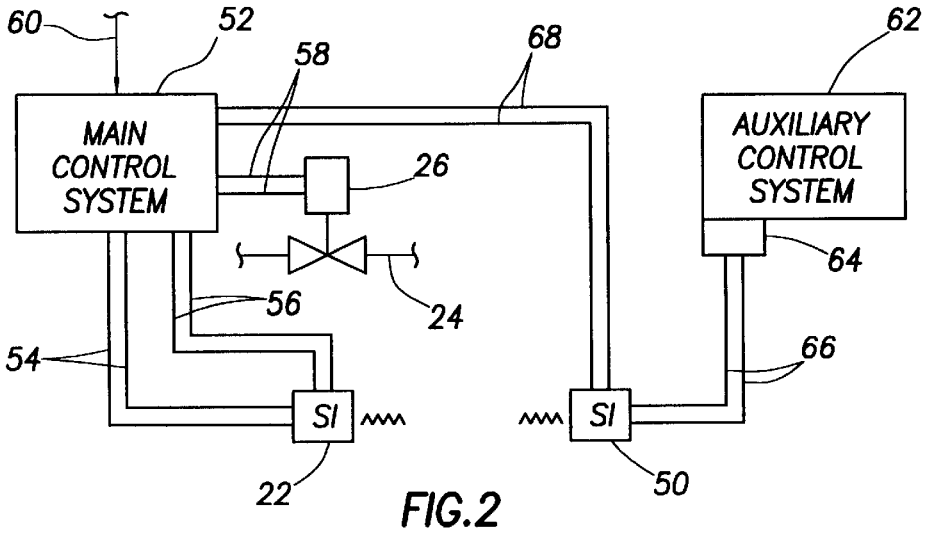
FIG. 2 is a schematic ignition control diagram for the water heater of FIG. 1.

Referring now to FIG. 2, a main control system 52 is connected to the spark igniter 22 by a pairs of electrical leads 54 and 56, and to the gas supply valve 26 by a pair of electrical leads 58. Upon receipt of a heating demand signal 60 from the heating thermostat (not shown), the main control system 52 transmits electrical power via the leads 58 to the gas valve 26 to open it, and transmits electrical power via leads 54 to the normally idle spark igniter 22 to cause it to spark until the gas burner 20 (see FIG. 1) is lit. The spark igniter 22 is then returned to its normal dormant mode. Appropriate electrical signals routed through the leads 56 are used to monitor and verify proper operation of the spark igniter 22. When the water heating demand is satisfied, and the demand signal 60 terminates, the main control system 52 terminates electrical power to the gas valve 26, thereby causing it to return to its normally closed position to shut off the gas burner 20.

An auxiliary control system 62 has a suitable timing section 64 which is connected to the spark igniter 50 by electrical leads 66. Spark igniter 50, in turn, is connected to the main control system 52 by electrical leads 68. Appropriate electrical signals routed through the leads 68 are used to monitor and verify proper operation of the spark igniter 50.

According to an aspect of the present invention, the auxiliary control system intermittently energizes the spark igniter 50 (representatively every 15 to 30 seconds, or at a greater or lesser time interval as conditions dictate), via leads 66, during both demand and non-demand periods of the water heater 10. This unique intermittent energization of the spark igniter 50 during non-firing periods of the water heater 10 provides for a "soft" ignition of flammable vapors 48 which may enter the combustion chamber 18 during standby periods of the water heater. This desirably softened ignition of flammable vapors 48 migrating into the combustion chamber 18 during off-duty periods of the water heater is achieved by substantially limiting the potential unignited flammable vapor build-up time within the combustion chamber.

Figure 3:
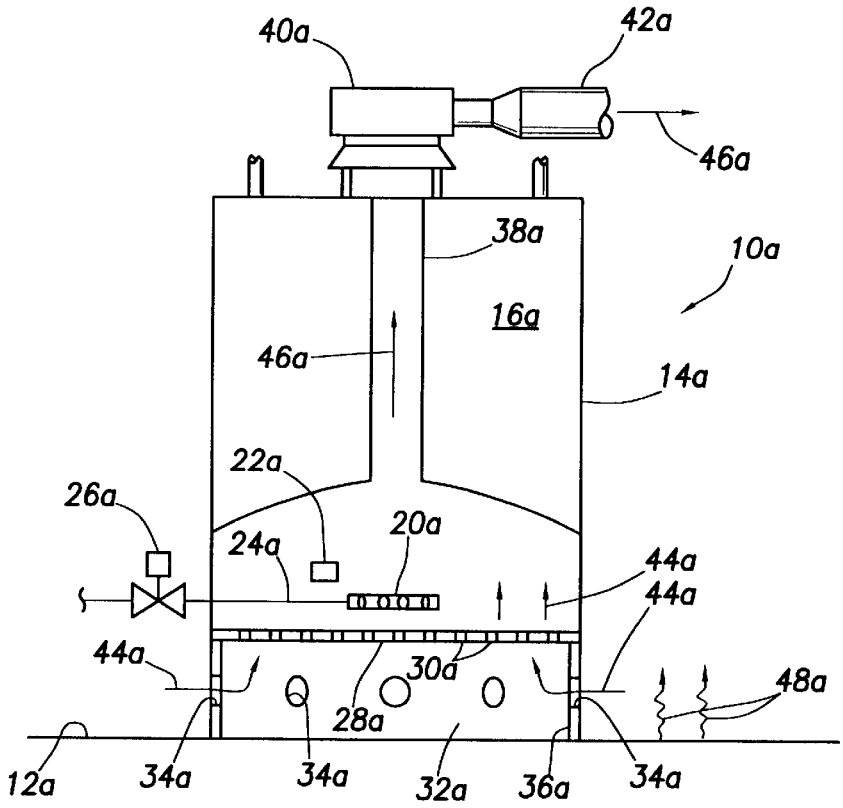
FIG. 3 schematically illustrates in simplified form a second embodiment of the power vented gas fired water heater.
Figure 4:
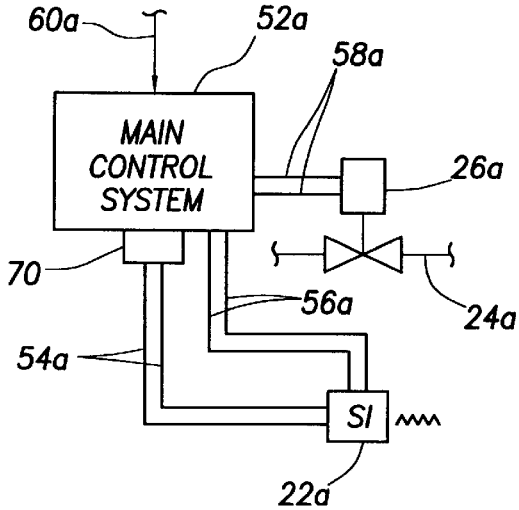
FIG. 4 is a schematic ignition control diagram for the water heater of FIG. 3.

A first alternate embodiment 10*a* of the previously described water heater 10, together with associated control apparatus, are schematically illustrated in FIGS. 3 and 4. For ease in comparison with the previously described water heater 10 and its associated control apparatus, components of the water heater 10*a* and its control apparatus similar to their counterparts in FIGS. 1 and 2 have been given the same reference numerals, but with the subscripts "a".

Turning now to FIGS. 3 and 4, the water heater 10*a* is substantially identical to the previously described water heater 10 with the exception that in the water heater 10*a* the second spark igniter 50 and its associated auxiliary control system 62 are eliminated, and the main spark igniter 22*a* is operated in a different manner which will now be described.

As schematically illustrated in FIG. 4, a suitable timing section 70 is incorporated in the main control system 52*a*, with the electrical leads 54*a* (via which the spark igniter 22*a* is energized) being interconnected between the spark igniter 22*a* and the timing section 70. In a conventional manner, the spark igniter 22*a* is energized in response to the receipt by the main control system 52*a* of the heating demand signal 60*a*. Additionally, however, the spark igniter 22*a* is intermittently energized (representatively every 15 to 30 seconds, or at a greater or lesser time interval as conditions dictate), via the timing section 70, during non-demand periods of the water heater 10*a*. Thus, the single spark igniter 22*a* performs the functions of the two spark igniters 22 and 50 in the water heater 10 in FIG. 1.

Figure 5:
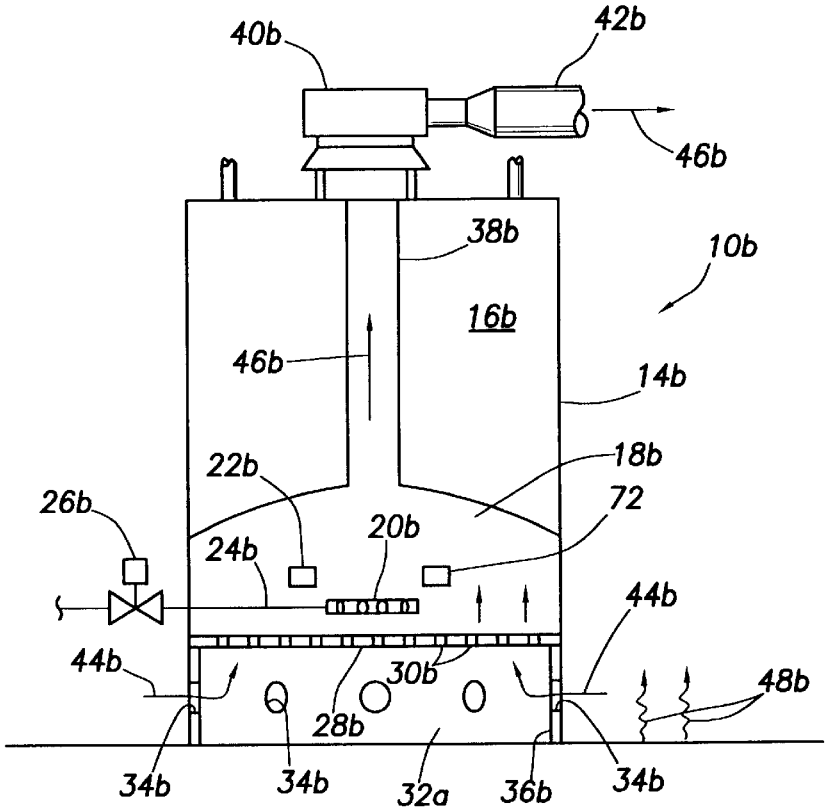
FIG. 5 schematically illustrates in simplified form a third embodiment of the power vented gas fired water heater.
Figure 6:
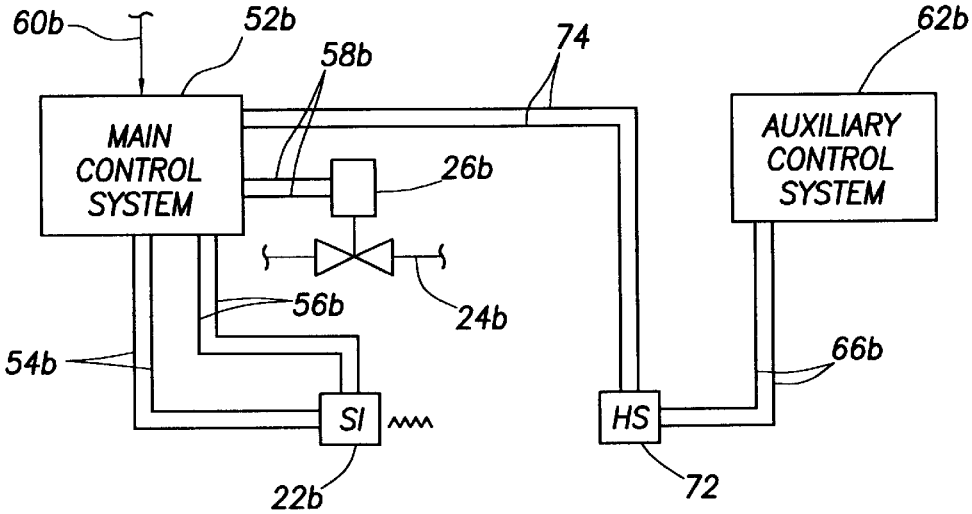
FIG. 6 is a schematic ignition control diagram for the water heater of FIG. 5.

A second alternate embodiment 10*b* of the previously described water heater 10, together with associated control apparatus, are schematically illustrated in FIGS. 5 and 6. For ease in comparison with the previously described water heater 10 and its associated control apparatus, components of the water heater 10*b* and its control apparatus similar to their counterparts in FIGS. 1 and 2 have been given the same reference numerals, but with the subscripts "b".

In the water heater 10*b* and its associated control apparatus shown in FIGS. 5 and 6, the spark igniter 50 is replaced by a continuously operative non-flame type ignition device such as a glow coil or hot surface igniter 72. The timing section 64 is deleted from the auxiliary control system 62*b*, and the ignition device 72 is connected to the main control system 52*b* by electrical leads 74 as indicated in FIG. 6. Appropriate electrical signals routed through the leads 74 are used to monitor and verify proper operation of the non-flame type ignition device 72. The spark ignition device 22*b* is energized in response to receipt of the heating demand signal 60*b* by the main control system 52*b*, with the auxiliary ignition device 72 being continuously energized during both demand and non-demand periods of the water heater 10*b*. The auxiliary ignition device 72 is thus operative to continuously provide for the "soft" ignition of extraneous flammable vapors 48*b* that may migrate into the combustion chamber 18*b* during non-demand periods of the water heater 10*b*.

As can be seen from the foregoing, the present invention provides, in several illustrative and non-limiting embodiments thereof, a power vented, fuel-fired water heater having a fuel burner disposed within a combustion chamber partially bounded by an arrestor structure with a spaced series of flame quenching combustion air inlet openings therein, and a non-flame type ignition device disposed within the combustion chamber and operated on at least an intermittent basis during non-demand periods of the water heater. As used herein, the phrases "operative at least intermittently", "operative on at least an intermittent basis", or the like, encompass both intermittent and continuous operation.

While the present invention has been representatively illustrated and described herein as being incorporated in a power vented, fuel fired water heater, it will be readily be appreciated by those of ordinary skill in this particular art that principles of the present invention could also be employed to advantage in other types of power vented, fuel fired heating appliances, such as boilers and furnaces, if desired.

The foregoing detailed description is to be clearly understood as being given by way of illustration and example only, the spirit and scope of the present invention being limited solely by the appended claims.

What is claimed is:

1. Power vented, fuel fired heating apparatus comprising:

a combustion chamber thermally communicatable with a fluid to be heated, said combustion chamber being partially bounded by a flame arrestor portion with spaced flame quenching combustion air inlet openings therein;

a fuel burner disposed within said combustion chamber and being operable during heating demand periods of said heating apparatus;

a flue operatively communicated with said combustion chamber;

a fan associated with said flue and operable to create a forced draft therein during said heating demand periods;

ignition apparatus including a non-flame type ignition device disposed within said combustion chamber; and control means for operating said non-flame type ignition device at least intermittently during non-heating demand periods of said heating apparatus.

2. The heating apparatus of claim 1 wherein said heating apparatus is a water heater.

3. The heating apparatus of claim 2 wherein said water heater is a gas fired water heater.

4. The heating apparatus of claim 1 wherein said non-flame type ignition device is intermittently operable by said control means during said non-heating demand periods.

5. The heating apparatus of claim 4 wherein said non-flame type ignition device is a spark igniter.

6. The heating apparatus of claim 4 wherein said non-flame type ignition device is additionally operable by said control means at the beginning of each heating demand period to light said fuel burner.

7. The heating apparatus of claim 1 wherein said non-flame type ignition device is continuously operable by said control means during said non-heating demand periods.

8. The heating apparatus of claim 7 wherein said non-flame type ignition device is a hot surface igniter.

9. The heating apparatus of claim 7 wherein said non-flame type ignition device is a glow coil.

10. The heating apparatus of claim 7 wherein said non-flame type ignition device is also continuously operable by said control means during said heating demand periods.

11. Power vented fuel fired heating apparatus comprising:

a combustion chamber thermally communicatable with a fluid to be heated, said combustion chamber being partially bounded by a flame arrestor portion with spaced flame quenching combustion air Inlet openings therein;

a fuel burner disposed within said combustion chamber and being operable during heating demand periods of said heating apparatus;

a flue operatively communicated with said combustion chamber;

a fan associated with said flue and operable to create a forced draft therein during said heating demand periods; and ignition apparatus including a non-flame type ignition device disposed within said combustion chamber and intermittently operable during non-heating demand periods of said heating apparatus, said non-flame type ignition device being intermittently operable at intervals ranging from about fifteen seconds to about thirty seconds during said non-heating demand periods.

12. Power vented, fuel fired heating apparatus comprising:

a combustion chamber thermally communicatable with a fluid to be heated, said combustion chamber being partially bounded by a flame arrestor portion with spaced flame quenching combustion air inlet openings therein;

a fuel burner disposed within said combustion chamber and being operable during heating demand periods of said heating apparatus;

a flue operatively communicated with said combustion chamber;

a fan associated with said flue and operable to create a forced draft therein during said heating demand periods; and Ignition apparatus including a non-flame type ignition device disposed within said combustion chamber and intermittently operable during non-heating demand periods of said heating apparatus, said non-flame type ignition device being an auxiliary non-flame type ignition device, and said ignition apparatus further including a primary non-flame type ignition device operable at the beginning of each heating demand period to light said fuel burner.

13. The heating apparatus of claim 12 wherein each of said primary and auxiliary non-flame type ignition devices is a spark igniter.

14. Power vented, fuel fired heating apparatus comprising:

a combustion chamber thermally communicatable with a fluid to be heated, said combustion chamber being partially bounded by a flame arrestor portion with spaced flame quenching combustion air inlet openings therein;

a fuel burner disposed within said combustion chamber and being operable during heating demand periods of said heating apparatus;

a flue operatively communicated with said combustion chamber;

a fan associated with said flue and operable to create a forced draft therein during said heating demand periods; and ignition apparatus including a non-flame type ignition device disposed within said combustion chamber and continuously operable during non-heating demand periods of said heating apparatus, said non-flame type ignition device being an auxiliary non-flame type ignition device, and said ignition apparatus further including a primary non-flame type ignition device operable at the beginning of each heating demand period to light said fuel burner.

15. The heating apparatus of claim 14 wherein:

said primary non-flame type ignition device is a spark igniter, and said auxiliary non-flame type ignition device is a hot surface igniter.

16. The heating apparatus of claim 14 wherein:

said primary non-flame type ignition device is a spark igniter, and said auxiliary non-flame type ignition device is a glow coil.

17. A method of operating a power vented, fuel fired heating appliance having a combustion chamber with a fuel burner therein, said method comprising the steps of:

disposing a non-flame type ignition device within said combustion chamber; and operating said non-flame type ignition device at least intermittently during non-heating periods of said heating appliance.

18. The method of claim 17 wherein said disposing step is performed by disposing a spark igniter within said combustion chamber.

19. The method of claim 17 wherein said disposing step is performed by disposing a hot surface igniter within said combustion chamber.

20. The method of claim 17 wherein said disposing step is performed by disposing a glow coil within said combustion chamber.

21. The method of claim 17 wherein said operating step is performed by intermittently operating said non-flame type ignition device during said non-heating demand periods of said heating appliance.

22. The method of claim 17 wherein said operating step is performed by continuously operating said non-flame type ignition device during said non-heating demand periods of said heating appliance.

* * * * *